US010797427B2

(12) United States Patent
Dupont et al.

(10) Patent No.: US 10,797,427 B2
(45) Date of Patent: Oct. 6, 2020

(54) CONNECTOR HOUSING EQUIPPED WITH AN IMPROVED CABLE TERMINAL POSITION ASSURANCE (TPA) DEVICE

(71) Applicant: RAYDIALL, Voiron (FR)

(72) Inventors: Mathieu Dupont, Voiron (FR); Rémi Duprez, Voiron (FR)

(73) Assignee: RAYDIALL, Voiron (FR)

( * ) Notice: Subject to any disclaimer, the term of this patent is extended or adjusted under 35 U.S.C. 154(b) by 0 days.

(21) Appl. No.: 16/420,679

(22) Filed: May 23, 2019

(65) Prior Publication Data

US 2020/0153144 A1 May 14, 2020

(30) Foreign Application Priority Data

Nov. 12, 2018 (FR) ..... 18 60421

(51) Int. Cl.
*H01R 13/426* (2006.01)
*H01R 43/20* (2006.01)
*H01R 13/627* (2006.01)

(52) U.S. Cl.
CPC ..... *H01R 13/426* (2013.01); *H01R 13/6271* (2013.01); *H01R 43/20* (2013.01)

(58) Field of Classification Search
CPC ... H01R 13/426; H01R 13/6271; H01R 43/20
USPC ..... 439/345
See application file for complete search history.

(56) References Cited

U.S. PATENT DOCUMENTS 5,252,096 A * 10/1993 Okada ..... H01R 13/4362 439/752
5,797,772 A * 8/1998 Sakurai ..... H01R 13/4362 439/752
5,830,013 A * 11/1998 Saito ..... H01R 13/4362 439/595
6,358,102 B1 * 3/2002 Fukamachi ..... H01R 13/4362 439/752
6,527,583 B2 * 3/2003 Plate ..... H01R 13/4362 439/157
6,659,797 B2 * 12/2003 Ichio ..... H01R 13/4361 439/595
6,749,469 B2 * 6/2004 Matsuoka ..... H01R 13/62911 439/752
6,780,070 B2 * 8/2004 Ishikawa ..... H01R 13/4362 439/752
7,347,742 B2 * 3/2008 Hall ..... H01R 13/6272 439/542
7,500,887 B2 * 3/2009 Ichio ..... H01R 13/4362 439/595
7,544,081 B2 * 6/2009 Lim ..... H01R 13/4361 439/352
7,556,539 B2 * 7/2009 Takahashi ..... H01R 13/4362 439/752

(Continued)

FOREIGN PATENT DOCUMENTS

WO 2014/060229 A1 4/2014
WO 2017/158566 A1 9/2017

*Primary Examiner* — Peter G Leigh
(74) *Attorney, Agent, or Firm* — Pearne & Gordon LLP

(57) ABSTRACT

The present application relates to a connector housing whose device, called terminal position assurance (TPA) device, installed so as to be able to slide inside the housing, transverse to its axis, is activated only by inserting a cable terminal whose body releases one or more flexible tabs of the TPA previously abutting against the housing.

8 Claims, 7 Drawing Sheets

(56) References Cited

U.S. PATENT DOCUMENTS

| | | | | |
|---|---|---|---|---|
| 7,563,135 | B2 * | 7/2009 | Takahashi | H01R 13/4362 439/488 |
| 7,682,205 | B2 * | 3/2010 | Hall | H01R 13/4361 439/752 |
| 8,137,142 | B1 | 3/2012 | Dawson et al. | |
| 8,277,248 | B2 * | 10/2012 | Blakborn | H01R 13/41 439/581 |
| 8,721,374 | B2 * | 5/2014 | Glick | H01R 13/426 439/596 |
| 9,142,919 | B2 | 9/2015 | Osada et al. | |
| 9,160,095 | B2 | 10/2015 | Littek et al. | |
| 9,379,475 | B2 * | 6/2016 | Endo | H01R 13/4361 |
| 9,407,026 | B2 * | 8/2016 | Campbell | H01R 13/4362 |
| 9,680,256 | B1 * | 6/2017 | Lane | H01R 13/6275 |
| 9,787,014 | B2 * | 10/2017 | Nagasawa | H01R 13/4362 |
| 9,893,467 | B2 * | 2/2018 | Chen | H01R 13/639 |
| 9,917,381 | B1 * | 3/2018 | Campbell | H01R 9/16 |
| 9,979,131 | B2 * | 5/2018 | Venkatesan | H01R 13/639 |
| 10,008,803 | B2 * | 6/2018 | Nagasawa | H01R 13/6272 |
| 10,038,278 | B2 * | 7/2018 | Lane | H01R 13/6272 |
| 10,109,950 | B1 * | 10/2018 | Campbell | H01R 13/6278 |
| 2003/0096539 | A1 * | 5/2003 | Ichio | H01R 13/4362 439/752 |
| 2004/0253882 | A1 * | 12/2004 | Fukatsu | H01R 13/4362 439/752 |
| 2008/0009171 | A1 * | 1/2008 | Tsuji | H01R 13/6272 439/352 |
| 2017/0317448 | A1 * | 11/2017 | Benichou | H01R 13/6272 |
| 2018/0316131 | A1 * | 11/2018 | Holub | H01R 43/26 |

* cited by examiner

[Fig 1]
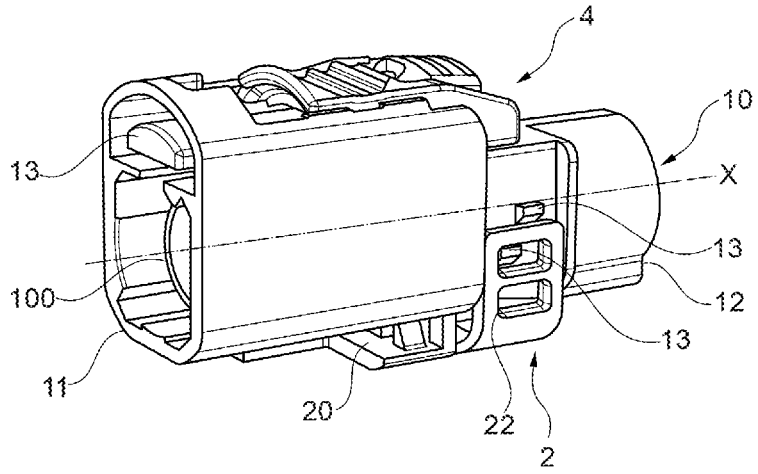
[Fig 2]
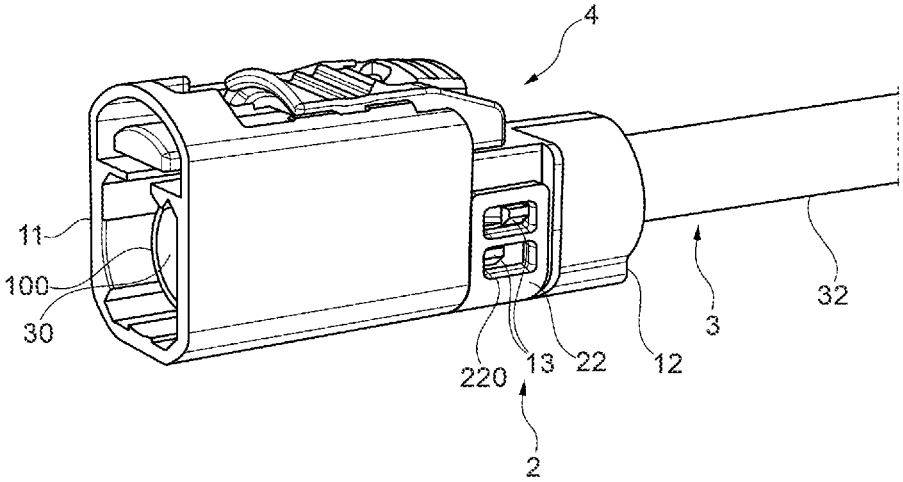

[Fig 3]
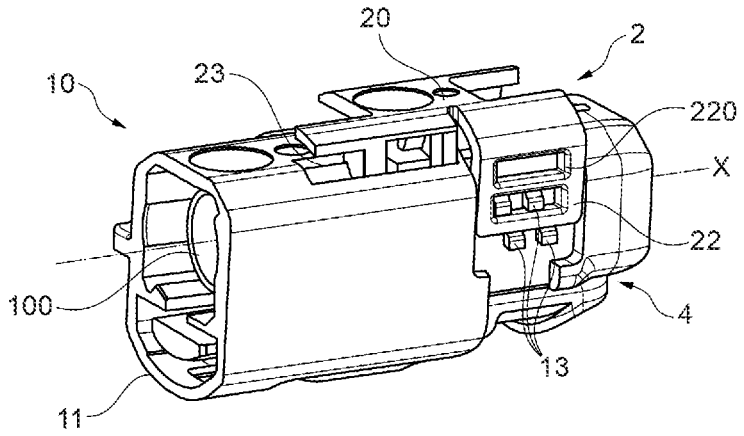
[Fig 3A]
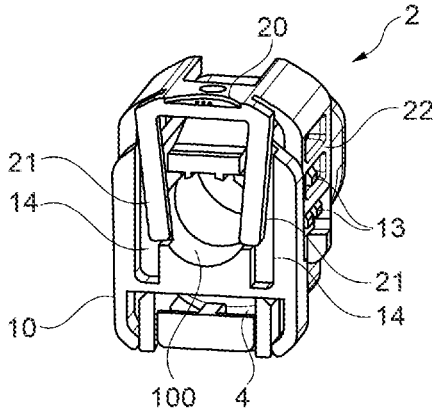
[Fig 4]
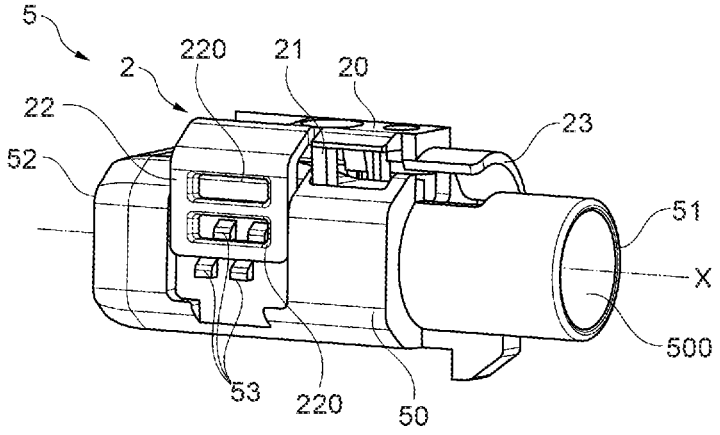

[Fig 5]
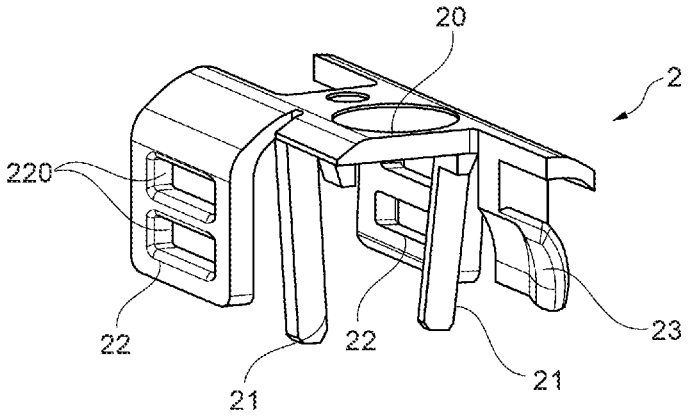
[Fig 6]
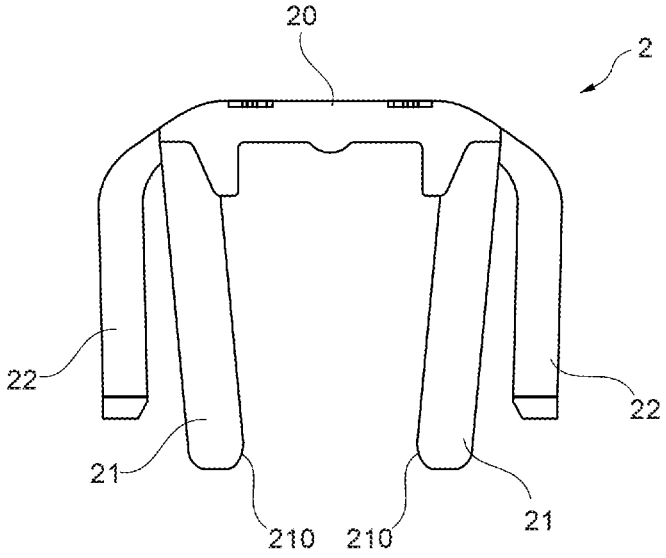

[Fig 7A]
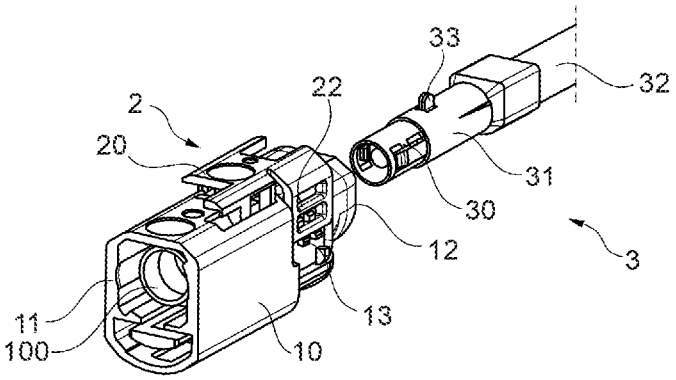
[Fig 7B]
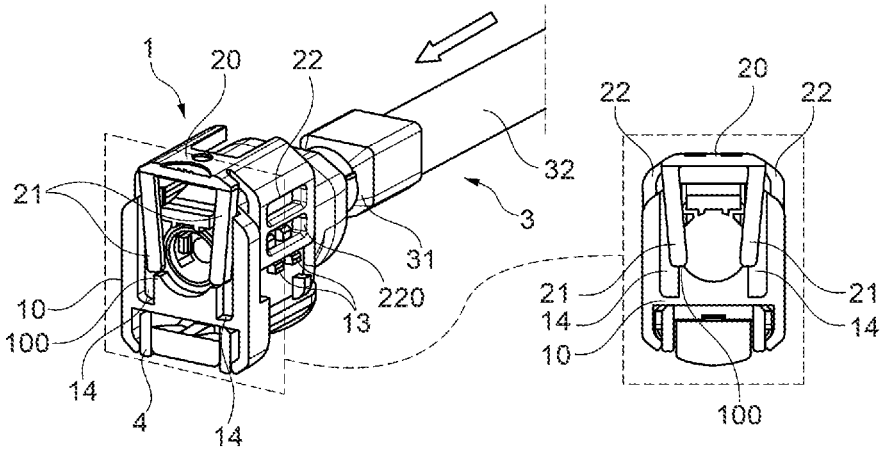
[Fig 7C]
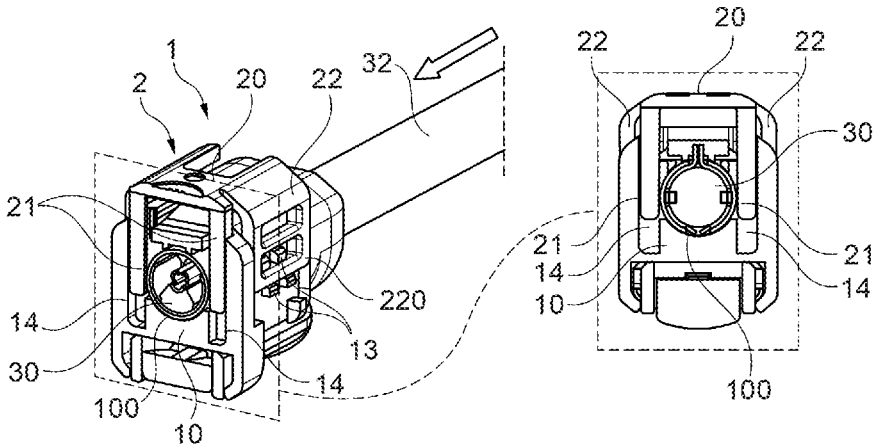

[Fig 7D]
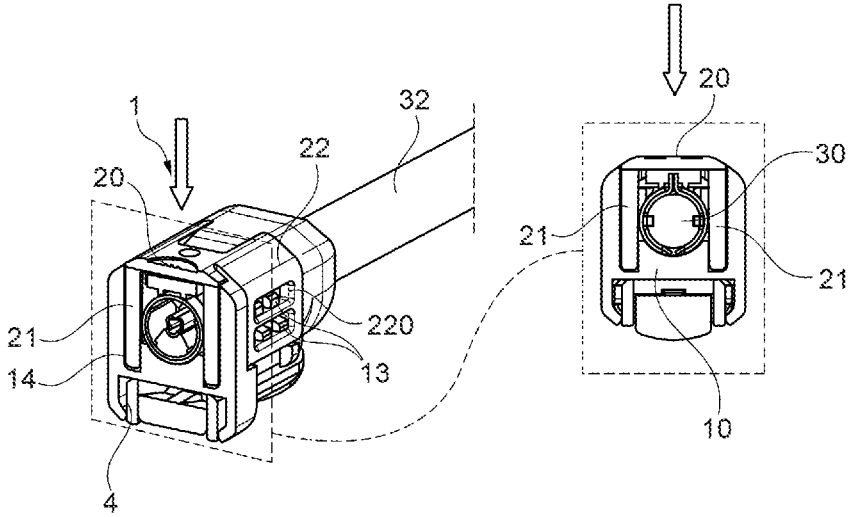
[Fig 8]
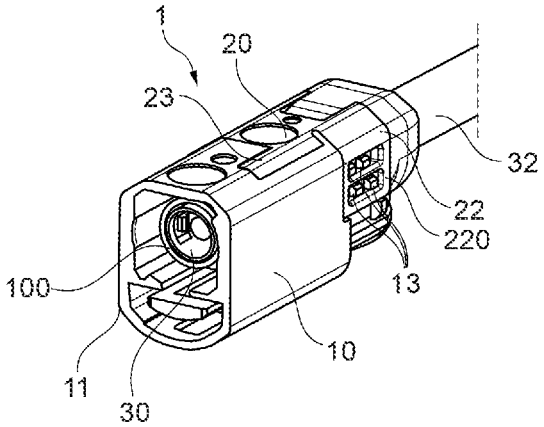

[Fig 9A]
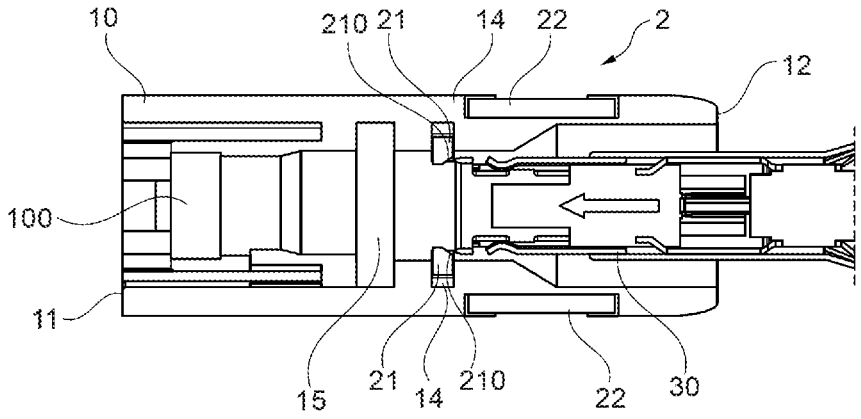
[Fig 9B]
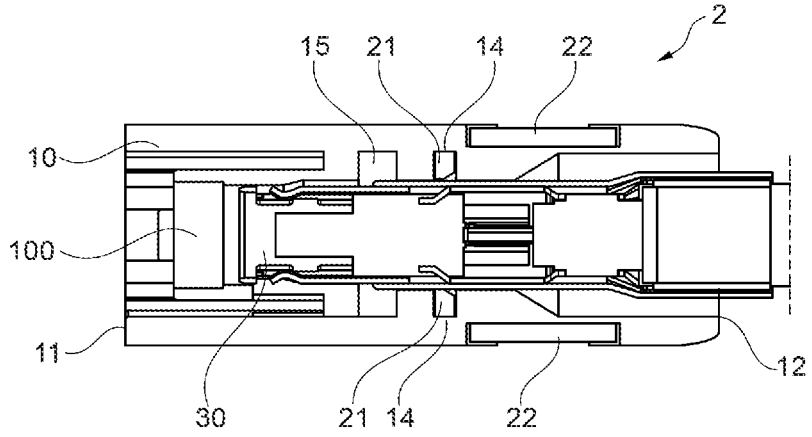

[Fig 10A]
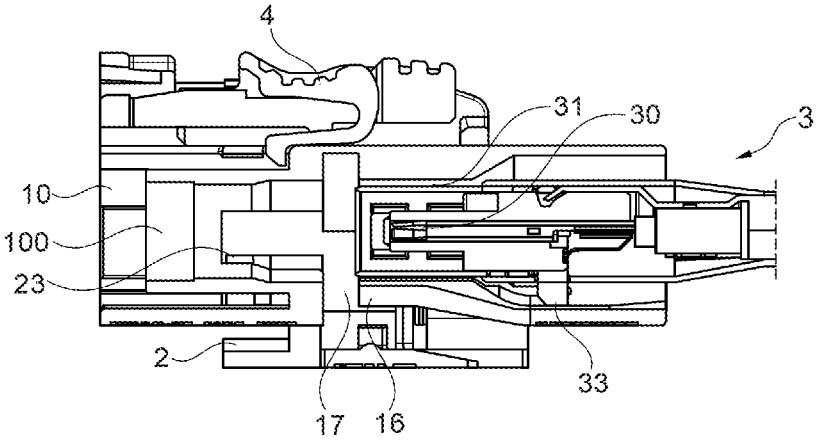
[Fig 10B]
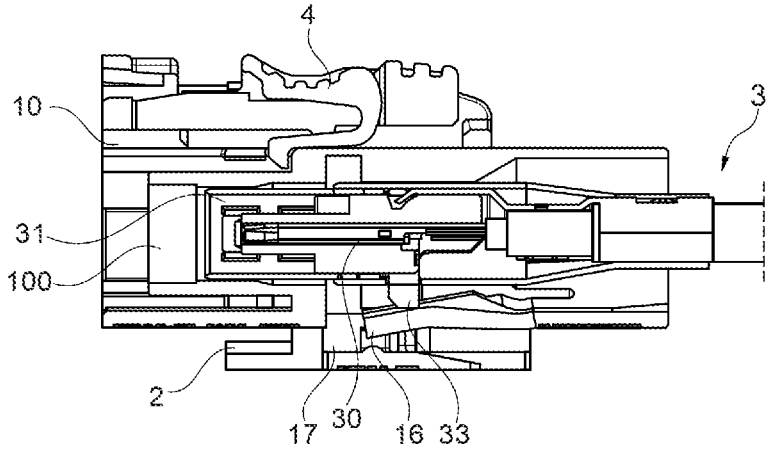
[Fig 10C]
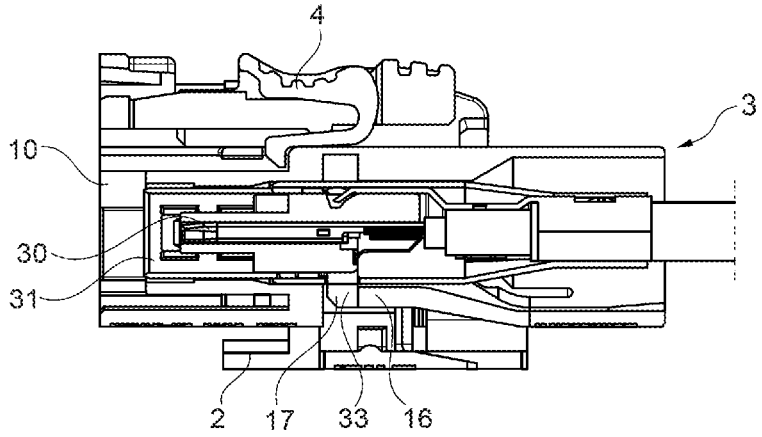

CONNECTOR HOUSING EQUIPPED WITH AN IMPROVED CABLE TERMINAL POSITION ASSURANCE (TPA) DEVICE

TECHNICAL FIELD

The present invention relates to connectors in the field of electrical and/or data transmission connector technology.

It relates more particularly to cable terminal position assurance (TPA) devices. The invention applies more generally to any type of connector technology for transmitting electrical signals and/or data and/or radiofrequency (RF) signals.

One advantageous application is connector technology for motor vehicles.

PRIOR ART

In the field of connector technology for transmitting electrical signals and/or data and/or radiofrequency (RF) signals, it is known that electrical, fiber-optic and other connections are made using two connectors that slot into one another, generally in the form of male and female connectors that are coupled to one another.

Each male or female connector includes electrical contacts, optical fibers or other conductors that are mutually situated and configured so as to provide a connection between one another when the male and female connectors are coupled to one another.

More precisely, each male or female connector comprises a housing in which a cable terminal is installed and fixed.

One general specification in the field of connectors is to ensure that, when the electrical cable terminal is correctly housed/positioned in the cavity of the housing that is dedicated thereto and locked, the terminal is not able to be inadvertently unlocked during the initial assembly of the connector or accidentally during use thereof. For example, following impacts and/or vibrations, one of the terminals could be decoupled and dislodged from its housing, without this being visible outside the connected housings.

Ultimately, this may lead to malfunctions due to the interruption of the signal or signals to be transmitted between the connectors or during use of the connector.

Defects of this type are particularly troubling in the automotive industry, in which the electrical/optical/data transmission components are subject to almost constant impacts and/or vibrations during normal use.

To avoid these problems, it is known, more particularly in the automotive industry, to equip a connector with a terminal position assurance (TPA in acronym form) device in order to secure locking of the terminals in the connectors and prevent unwanted disconnection.

A TPA device performs the function of securing the locking of a cable terminal in a housing. When the terminal is housed and locked in its housing, the TPA is moved from its position awaiting locking to its active position of securing locking of the terminal.

The major drawback of existing TPA devices is that they may be put into their active position in the housing, even if no terminal is actually installed in the housing.

Secondly, the function of a TPA also consists in preventing any connection to a complementary connector when the TPA is not in the active position, any attempt to couple a complementary connector housing failing due to the presence of a dedicated part at the front of the TPA against which the complementary connector housing abuts.

However, current TPAs may be put into an active securing position even in the absence of a terminal in the housing.

There is therefore a need to improve solutions for securing the locking of a cable terminal in a connector housing using a TPA device, in particular in order to overcome the abovementioned major drawback.

The aim of the invention is to at least partly meet this need.

DISCLOSURE OF THE INVENTION

To this end, the invention relates to a connector housing, intended to be coupled to a complementary connector housing, and to house a cable terminal, the housing extending along a longitudinal axis (X) and comprising:

- a body comprising at least one first recess that extends transverse to the axis X;
- a device, called terminal position assurance (TPA) device, installed so as to be able to slide transverse to the axis X inside the housing between a position awaiting locking and an active position of securing locking between the cable terminal and the connector housing, the TPA device comprising at least one flexible tab configured so as respectively to be:
- blocked against the body of the housing in a waiting position, when no cable terminal is inserted into the housing,
- deflected by the conductor of the terminal when it is inserted into the connector housing.

The flexible tab is preferably furthermore configured so as to be blocked inside the first recess of the housing body when the TPA is in its active position.

According to one advantageous variant embodiment, the flexible tab is designed, when it is blocked in its waiting position, so as not to allow the TPA device to slide into its active position if a terminal is not inserted into the housing.

In other words, the invention consists in defining a connector whose TPA installed so as to be able to slide inside the housing, transverse to its axis, is activated only by inserting a cable terminal whose body releases one or more flexible tabs of the TPA previously abutting against the housing.

The solution according to the invention thus makes it possible to prevent any activation of the TPA if no cable terminal is inserted into the housing equipped with the TPA, and therefore the connection between two complementary connectors.

In yet other words, a TPA according to the invention is able to be activated only on the condition that the terminal is effectively housed in its housing.

Therefore, the connection between two complementary connectors may only be made if the two terminals are inserted correctly into the receptive housings of this pair of complementary connectors.

The TPA according to the invention therefore provides additional security in comparison with the TPAs according to the prior art.

According to one advantageous embodiment, the flexible tab is arranged such that it runs at least partially into the central passage of the housing when it is in its waiting position, and that it is housed completely in the wall of the housing in the active position.

Advantageously, the flexible tab is designed, when it is blocked in its waiting position, so as not to allow the TPA device to slide into its locking position if a terminal is not inserted into the housing.

Each flexible tab preferably comprises a chamfer at its free end, designed so as to facilitate the insertion of the conductor into the housing.

According to one advantageous embodiment:

the body of the housing comprises at least two retaining and locking lugs;

the TPA device comprises at least two retaining and locking tongues each equipped with at least one aperture designed so as to interact with one of the lugs so as to hold the TPA device on the housing both in its waiting position and in its active position.

According to another advantageous embodiment:

the body comprises at least one second recess, called locking recess;

the TPA device comprises at least one locking protrusion designed so as to be housed in the second recess and block the conductor in the locking position of the TPA through jamming.

The invention also relates to a connector comprising:

a connector housing equipped with a TPA device such as described above;

an electrical cable terminal housed and locked in the body of the housing by way of the TPA device.

According to one advantageous embodiment, the connector comprises a device, called connector position assurance (CPA) device, designed so as to secure the locking of a complementary connector coupled to the connector.

The invention also relates to a method for installing a cable terminal in a connector such as described above, comprising the following steps:

a/ inserting the terminal so as to bring about the deflection of the at least one flexible tab and thus clear the TPA device from its waiting position;

b/ once the terminal is positioned in its connection position, moving the TPA device cleared from its waiting position in translation transverse to the axis X, so as to secure the locking of the terminal in the housing.

DETAILED DESCRIPTION

Other advantages and features of the invention will become more clearly apparent upon reading the detailed description of exemplary implementations of the invention, given by way of nonlimiting illustration, and with reference to the following figures, in which:

FIG. 1 is a perspective view of an example of a female connector housing equipped with a TPA device according to the invention in its waiting position;

FIG. 2 is a perspective view of a connector with a female housing equipped with its TPA device according to FIG. 1 and in which a cable terminal is installed and held with locking by virtue of the TPA device;

FIG. 3 is another perspective view of the female housing according to FIG. 1, with the TPA device in the waiting position;

FIG. 3A is a cross-sectional view of the housing with its TPA device according to FIG. 3;

FIG. 4 is a perspective view of an example of a male connector housing equipped with a TPA device according to the invention in the waiting position, this male housing being intended to be coupled and locked to the female housing according to FIGS. 1 to 3A;

FIGS. 5 and 6 are perspective views of a TPA device according to the invention;

FIGS. 7A to 7D are perspective and cross-sectional views showing the various steps of installing a cable terminal in a female connector housing with the operation of a TPA device according to the invention;

FIG. 8 is a perspective view of a connector with a female housing in which a cable terminal is installed and held with locking by virtue of the TPA device;

FIGS. 9A and 9B are longitudinal sectional views of a connector showing some steps of installing a cable terminal in a female connector housing with the operation of a TPA device according to the invention;

FIGS. 10A to 10C are longitudinal sectional views of a connector equipped with a TPA device according to the invention, showing the locking of a cable terminal in a female connector housing.

It is specified here that, throughout the present application, the terms "lower", "upper", "above", "below", "inside", "outside", "inner" and "outer" are to be understood with reference to a connector according to the invention in a substantially horizontal configuration.

As illustrated in FIGS. 1 and 2, a female connector 1 according to the invention comprises a housing 10 with a body that houses an electrical and/or data cable terminal 3 that is held and locked by way of a removable device 2, called "terminal position assurance" (TPA in acronym form) device. Another device 4, called connector position assurance (CPA in acronym form) device, is installed so as to be able to slide in the housing 10. The CPA device is not obligatory, and the TPA device may be present on its own.

The CPA device 4 is described and claimed in the patent application entitled "Connector housing equipped with an improved connector position assurance (CPA) device", filed in the name of the applicant on the same day as the present application.

The conductor 30 of the terminal 3 is intended to be connected through coupling to a conductor 20 of a complementary connector 2, through the front face 11 of the body of the housing 10. The conductor 30 is held inside a drum 100 inside the connector housing 10.

In the active position of the TPA device 2, the body 31 of the terminal 3 is locked inside the housing 10, and the cable 32 of the terminal emerges from the body of the housing 10 through its rear face 12.

The body 31 of the terminal 3 comprises a locking lug 33 that projects toward the outside.

FIG. 4 illustrates a male housing 50, complementary to the female housing 10 with its removable TPA device 2 in the waiting position.

In the active position of the TPA device 2, the body 31 of a terminal 3 is locked and secured inside the housing 50, and the cable 32 of the terminal emerges from the housing 50 through its rear face 52.

As illustrated in FIGS. 1 to 4, the body of the housing 10, 50 comprises retaining and locking lugs 13 that are integrally molded.

These retaining and locking lugs 13 are designed so as to interact through snapping-in with the flexible tongues 22 of the TPA device 2, firstly in order to hold the latter on the housing 10, 50 in its position awaiting locking, and secondly in order to hold it and lock it in its active locking securing position.

The housing body 10, 50 also comprises first recesses 14, in the form of grooves open toward the outside, designed so as to house the flexible tabs 21 of the TPA 2 in its active position, and a second recess also open to the outside, designed so as to house the stop protrusion 23 of the TPA, as described hereinafter.

The TPA device 2, produced as a single part, is installed in the housing 10, between a waiting position and an active position, as explained hereinafter.

The TPA device 2 essentially comprises a head 20 with a manual pressing zone.

Two flexible tabs 21, which are preferably identical, are linked to the head 20, on either side and at the front end thereof. As explained, the function of these flexible tabs 21 is to block the TPA device 2 in translation against the housing 10 in its position awaiting unlocking.

Two flexible tongues 22, which are preferably identical, are also linked to the head 20 on either side and at the rear end thereof. Each of these tongues 22 comprises two apertures 220 corresponding either to the waiting position or to the active position. These retaining and locking apertures 220 are each designed so as to snap in around a retaining and locking lug 13 of the housing 10, so as to hold the TPA device 2 in both its waiting and locking position and to lock it to the housing 10.

A description is now given with reference to FIGS. 7A to 7D of the various steps of connection, with locking by the TPA device 2, of a cable terminal 3 in a female connector 1 housing 10 according to the invention.

Step a/: A cable terminal 3 is placed at the rear face 12 of a connector housing 10. In this approach phase, the TPA device 2 is in the position awaiting locking (FIG. 7A). The apertures 220 are snapped in around the retaining lugs 13 on the top of the housing 10, and thus hold the TPA device 2 in this waiting position, which is the position furthest from the housing 10.

In this waiting position, the stop protrusion 23 prevents any coupling of a complementary connector housing.

Step b/: The terminal 3 is moved in translation so as to insert it inside the housing 10, as symbolized by the black arrow in FIG. 7B.

In this phase of beginning of insertion, the tabs 21 have a position close to one another and are in abutment against part of the drum 100 of the housing (FIG. 7B). In the example illustrated, the parts of the drum 100 that have the stop function are each in the form of a flat spot.

The TPA device 2 is thus blocked, that is to say that the abutting tabs 21 prevent any undesired translation thereof (FIG. 7B).

Step c/: By continuing to insert the terminal 3 into the housing 10, the end of the conductor 30 spreads the tabs 21 outward through deflection, thereby positioning each of them facing a groove 14 (FIG. 7C). In this phase, the translation of the TPA device 2 is therefore possible transverse to the axis X (FIG. 7C).

Step d/: Once the conductor 30 has reached its final position in the drum 100 of the housing 10, locking thereof may take place (FIG. 7D).

The method then ends by moving the TPA device 2 transversely in translation by manually pressing on the surface 20 provided for this purpose. The translation in the direction of the black arrow in FIG. 7D makes it possible to bring the stop protrusion 23 into the recess 15.

At the same time, the tabs 21 are housed completely in the recesses 14 (FIG. 7D).

The apertures 220 are snapped in around the retaining lugs 13 on the bottom of the housing 10, and thus hold and lock the TPA device 2 in this active position, which is the position closest to the housing 10.

The TPA device 2 thus secures the locking of the cable terminal 3 in the housing 10 (FIG. 8). In this locking position as well, the TPA device 2 is in mechanical abutment against the housing 10 (FIG. 8).

FIGS. 9A and 9B show the function of the chamfers 210 formed at the end, which facilitate the insertion of the conductor 30 into the housing 10, said conductor then spreading the flexible tabs 21 from its passage into the drum 100 of the housing.

FIGS. 10A to 10C show the locking of the terminal 3 in the connector housing 10 being performed, before the activation of a TPA device 2 according to the invention.

Upon connection, the locking lug 33 deflects the holding tongue 16 of the terminal 3, formed in the housing (FIG. 10B).

As long as the locking lug is not housed in the locking recess 17 dedicated thereto (FIG. 10C), it is not possible to lock the TPA because the tongue 16 remains deflected.

Other variants and advantages of the invention may be realized without however departing from the scope of the invention.

A single tab 21 may thus be contemplated, as may a single tab 22. In this case, it is preferable for them to be on opposing sides in order to limit any rotation of the TPA.

A TPA device according to the invention may be fitted equally to a female housing or to a male housing.

In one advantageous variant, the TPA in the active position does not have any surface projecting from the surface of the housing.

It is possible to contemplate having the retaining and locking lugs 13 borne by the TPA device, whereas complementary grooves would be produced in the housing.

The invention is not limited to the examples that have just been described; it is possible in particular to combine features of the examples illustrated with one another in variants that are not illustrated.

The invention claimed is:

1. A connector housing, intended to be coupled to a complementary connector housing, and to house a cable terminal, the connector housing extending along a longitudinal axis (X) and comprising:

a body comprising at least one first recess that extends transverse to the longitudinal axis (X);

a terminal position assurance (TPA) device; installed so as to be able to slide transverse to the longitudinal axis (X) inside the connector housing between an unlocking position and a locking position between the cable terminal and the connector housing, the TPA device comprising at least one flexible tab configured so as respectively to be:

blocked in the body of the connector housing in a waiting position, when no cable terminal is inserted into the connector housing, deflected by a conductor of the cable terminal when it is inserted into the connector housing, wherein the at least one flexible tab is arranged such that the at least one flexible tab runs at least partially into the central passage of the connector housing when the at least one flexible tab is in its waiting position, and that the at least one flexible tab is housed completely in a wall of the connector housing in an active position.

2. The connector housing as claimed in claim 1, wherein the at least one flexible tab is designed, when the at least one flexible tab is blocked in its waiting position, so as not to allow the TPA device to slide into a locking position if the cable terminal is not inserted into the connector housing.

3. The connector housing as claimed in claim 1, wherein each flexible tab comprises a chamfer at its free end, designed so as to facilitate the insertion of the conductor into the connector housing.

4. The connector housing as claimed in claim 1, wherein:

the body of the connector housing comprises at least two retaining and locking lugs;

the TPA device comprises at least two retaining and locking tongues, each equipped with at least one aperture designed so as to interact with one of the lugs and to hold the TPA device in the connector housing, both in its waiting position and in its active position.

5. The connector housing as claimed in claim 1, wherein:

the body comprises at least one second recess comprising a locking recess;

the TPA device comprises at least one locking protrusion designed to be housed in the second recess and to block the conductor in the locking position of the TPA through jamming.

6. A connector comprising:

a connector housing equipped with a TPA device as claimed in claim 1;

an electrical cable terminal housed and locked in the body of the connector housing by way of the TPA device.

7. The connector as claimed in claim 6, comprising a connector position assurance (CPA) device designed so as to secure the locking of a complementary connector coupled to the connector.

8. A method for installing a cable terminal in a connector as claimed in claim 1, comprising the following steps:

a/ inserting the cable terminal so as to bring about the deflection of the at least one flexible tab and thus clear the TPA device from its waiting position;

b/ once the cable terminal is in a connection position, moving the TPA device cleared from its waiting position transverse to the longitudinal axis (X), so as to secure the locking of the cable terminal in the connector housing.

* * * * *